US007943085B2

(12) United States Patent
Tomita et al.

(10) Patent No.: US 7,943,085 B2
(45) Date of Patent: May 17, 2011

(54) FERRITIC STAINLESS STEEL FOR AUTOMOBILE EXHAUST GAS PASSAGE COMPONENTS AND WELDED STEEL PIPE

(75) Inventors: Takeo Tomita, Shunan (JP); Manabu Oku, Shunan (JP)

(73) Assignee: Nisshin Steel Co., Ltd., Tokyo (JP)

( * ) Notice: Subject to any disclaimer, the term of this patent is extended or adjusted under 35 U.S.C. 154(b) by 640 days.

(21) Appl. No.: 11/987,867

(22) Filed: Dec. 5, 2007

(65) Prior Publication Data

US 2008/0138233 A1 Jun. 12, 2008

(30) Foreign Application Priority Data

Dec. 7, 2006 (JP) ..... 2006-330252

(51) Int. Cl.
*C22C 38/18* (2006.01)
*C22C 38/22* (2006.01)
*C22C 38/00* (2006.01)

(52) U.S. Cl. ..... 420/60; 420/61; 420/62; 420/64; 420/70

(58) Field of Classification Search ..... 148/325, 148/328, 330, 332, 336; 420/34, 60, 62, 420/64, 70, 89–93, 103, 119, 120, 121, 126, 420/127

See application file for complete search history.

(56) References Cited

U.S. PATENT DOCUMENTS 6,673,166 B2 * 1/2004 Oku et al. ..... 148/326

FOREIGN PATENT DOCUMENTS

| | | |
|---|---|---|
| JP | 2005-264269 | 9/2005 |
| JP | 2006-117985 | 5/2006 |
| WO | WO 03/004714 | 1/2003 |

OTHER PUBLICATIONS

Computer-Generated Translation of JP 2006-117985.*

* cited by examiner

*Primary Examiner* — Scott Kastler
*Assistant Examiner* — Vanessa Velasquez
(74) *Attorney, Agent, or Firm* — Clark & Brody

(57) ABSTRACT

A ferritic stainless steel for automobile exhaust gas passage components comprises, in mass percent, C: not more than 0.03%, Si: not more than 1%, Mn: not more than 1.5%, Ni: not more than 0.6%, Cr: 10-20%, Nb: not more than 0.5%, Ti: 0.05-0.3%, Al: more than 0.03% to 0.12%, Cu: more than 1% to 2%, V: not more than 0.2%, N: not more than 0.03%, B: 0.0005-0.02%, O: not more than 0.01%, and the balance of Fe and unavoidable impurities, whose composition satisfies the relationships Nb≧8 (C+N) and 0.02≦Al−(54/48))≦0.1. The steel enables fabrication of automobile exhaust gas passage components that are excellent in high-temperature strength and weld toughness, and offers a wide range of freedom in selecting suitable pipe-making conditions.

7 Claims, 2 Drawing Sheets

FERRITIC STAINLESS STEEL FOR AUTOMOBILE EXHAUST GAS PASSAGE COMPONENTS AND WELDED STEEL PIPE

BACKGROUND OF THE INVENTION

This invention relates to a ferritic stainless steel and its welded pipe used in the exhaust gas passage components of an automobile, typically in the exhaust manifold, catalytic converter case (cylindrical casing), front pipe and center pipe, and to automobile exhaust gas passage components utilizing the ferritic stainless steel and welded steel pipe.

The exhaust gas passage components of an automobile, such as the exhaust manifold, catalytic converter case, front pipe and center pipe, are required to be excellent in high-temperature oxidation resistance and high-temperature strength in the high-temperature region exceeding 700° C. As a material having such heat resistance, Patent Documents 1 and 2 teach ferritic stainless steels added with about 1 to 2 mass % of Cu. The Cu in the steel precipitates as Cu phase under heating to improve the high-temperature strength and thermal fatigue property of the steel.

Most of the aforesaid automobile exhaust gas passage components are produced by shaping welded steel pipes. Owing to the increasing number of units installed in the engine compartment in recent years, the amount of space available for installation of exhaust gas passage components has continued to decrease. This has led to many exhaust gas passage components being manufactured in complex shapes by special processing. The welded steel pipes used in exhaust gas passage components are therefore required to have even better formability than heretofore.

Regarding a technique for improving the formability of welded steel pipe made of ferritic stainless steel, Patent Document 3 teaches that trace addition of Al or Ti enhances the toughness and secondary workability of the weld. However, a study carried out by the inventors showed that trace addition of Al or Ti to ferritic stainless steel improved in high-temperature strength by inclusion of 1 to 2% Cu as mentioned above does not readily ensure sufficient toughness of a steel pipe produced by high-frequency welding. Moreover, sufficient toughness is even harder to achieve in a component such as a catalytic converter case because the component is manufactured by subjecting a steel pipe that has been TIG welded or laser welded to very severe compressive working (pressing or spinning). In other words, it was found that a welded steel pipe made of a ferritic stainless steel containing around 1 to 2% Cu cannot be adequately improved in toughness merely by trace addition of Al or Ti as taught by Patent Document 3.

In addition, the weld toughness of a high-frequency welded pipe is particularly easily affected by the pipe-making conditions determined by the amount of upset and heat input. In a ferritic stainless steel containing 1 to 2% Cu, the difficulty of consistently securing good toughness becomes even greater when the pipe-making conditions deviate from the optimum conditions.

Patent Document 1: WO 03/004714
Patent Document 2: JP 2006-117985A
Patent Document 3: JP 2005-264269A

SUMMARY OF THE INVENTION

An object of the present invention is to provide a ferritic stainless steel for automobile exhaust gas passage components which is a Cu-containing ferritic stainless steel excellent in high-temperature oxidation resistance and high-temperature strength that excels in the toughness of a weld formed during pipe-making (in this specification, "weld" is defined to include the welded metal and surrounding heat-affected metal) and that offers a wide range of freedom in selecting suitable pipe-making conditions especially when subjected to high-frequency welding pipe-making.

An in-depth study conducted by the inventors revealed that good toughness of the weld of ferritic stainless steel enhanced in high-temperature strength by Cu-phase precipitation can be effectively achieved by adding Ti and Al in combination and further strictly defining the Al content relative to the O (oxygen) content of the steel, thereby expanding the range of suitable pipe-making conditions in high-frequency welding pipe-making.

Specifically, the aforesaid object is achieved by a ferritic stainless steel for automobile exhaust gas passage components comprising, in mass percent, C: not more than 0.03%, Si: not more than 1%, Mn: not more than 1.5%, Ni: not more than 0.6%, Cr: 10-20%, Nb: not more than 0.5%, Ti: 0.05-0.3%, Al: more than 0.03% to 0.12%, Cu: more than 1% to 2%, V: not more than 0.2%, N: not more than 0.03%, B: 0.0005-0.02%, O: not more than 0.01%, optionally one or more of Mo, W, Zr and Co: total of not more than 4%, and the balance of Fe and unavoidable impurities, the composition satisfying Expressions (1) and (2)

$$Nb \geqq 8(C+N) \quad (1),$$

$$0.02 \leqq Al-(54/48)O \leqq 0.1 \quad (2).$$

Each element symbol in Expressions (1) and (2) is replaced by a value representing the content of the element in mass percent.

Further, the present invention provides exhaust gas passage components of an automobile, typically in the exhaust manifold, catalytic converter, front pipe, center pipe, and other exhaust gas passage utilizing the welded steel pipe made of the aforesaid steel above.

The present invention enables actualization of welded ferritic stainless steel pipe that possesses the heat resistance (high-temperature oxidation resistance and high-temperature strength) required of automobile exhaust gas passage components and also exhibits excellent weld toughness. Moreover, the present invention provides greater freedom in selecting suitable pipe-making conditions at the time of manufacturing the welded pipe. Therefore, even in the case of high-frequency welding pipe-making conducted at a high line speed, for example, high-quality steel pipe with good weld toughness can be reliably manufactured.

DESCRIPTION OF THE PREFERRED EMBODIMENT

Figure 1:
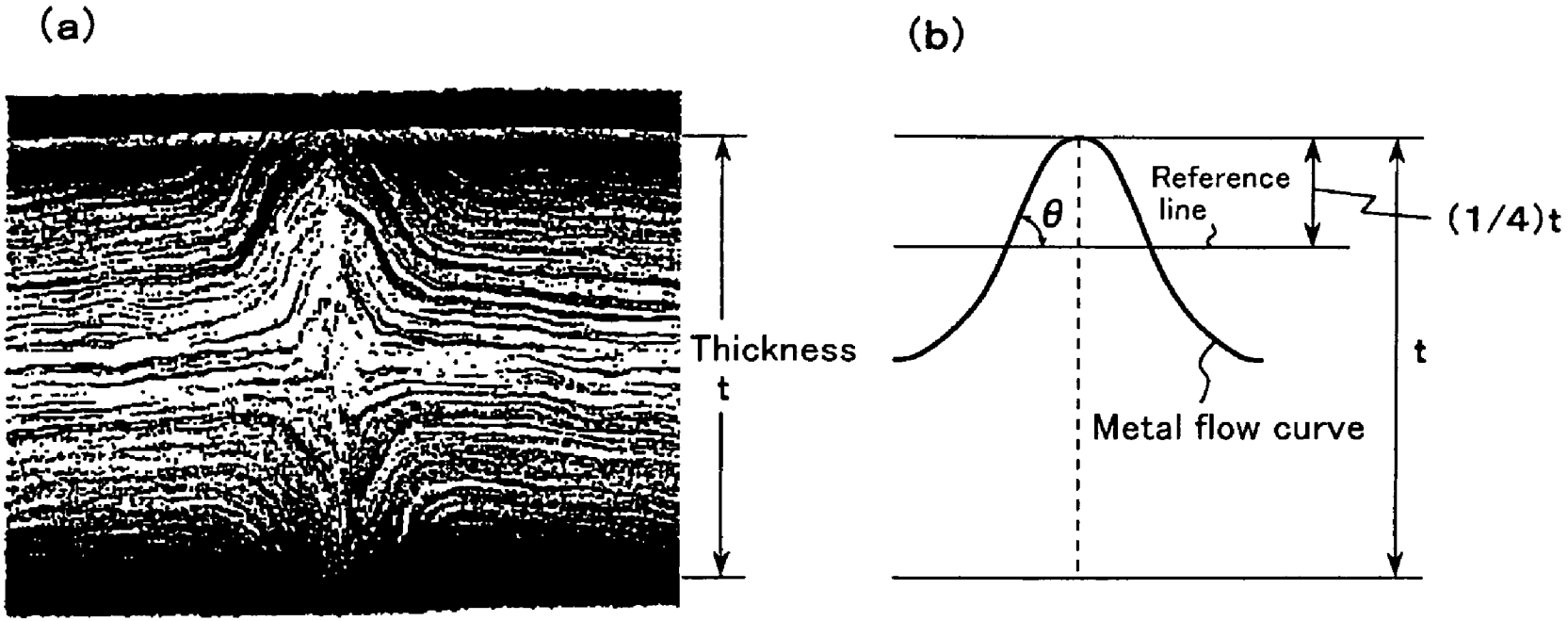
FIG. 1 is a microphotograph showing an example of metal flow observed at a weld cross-section of a high-frequency welded pipe.

The composition of the ferritic stainless steel will now be explained.

C and N are generally effective for improving creep strength and other high-temperature strength properties but degrade oxidation resistant property, workability, low-temperature toughness and weldability when contained in excess. In this invention, both C and N are limited to a content of not more than 0.03 mass %.

Si is effective for improving high-temperature oxidation resistance. Moreover, it bonds with atmospheric oxygen during welding to help keep oxygen from entering the steel. However, when contained in excess, it increases hardness and thus degrades workability and low-temperature toughness. In this invention, Si content is limited to not more than 1 mass % and can, for example, be limited to 0.1-0.6 mass %.

Mn improves high-temperature oxidation resistance, especially scale peeling resistance. And like Si, it also bonds with atmospheric oxygen during welding to help keep oxygen from entering the steel. However, Mn impairs workability and weldability when added in excess. Further, Mn is an austenite stabilizing element that when added in a large amount facilitates generation of martensite phase and thus causes a decline in workability and other properties. Mn content is therefore limited to not more than 1.5 mass %, preferably not more than 1.3 mass %. It can, for instance, be defined as 0.1 mass % to less than 1 mass %.

Ni is an austenite stabilizing element. Like Mn, it facilitates generation of martensite phase when added in excess and thus degrades workability and the like. A Ni content of up to 0.6 mass % is allowable.

Cr stabilizes ferrite phase and contributes to improvement of oxidation resistance, an important property of high-temperature steels. But an excessive Cr content makes the steel brittle and lowers its oxidation resistance. The Cr content is therefore defined as 10-20 mass %. The Cr content is preferably optimized for the use temperature of the steel. For example, when the temperature up to which good high-temperature oxidation resistance is required is up to 950° C., the Cr content is preferably 16 mass % or more, and when up to 900° C., is preferably 12-16 mass %.

Nb is a highly effective element for obtaining good high-temperature strength in the high-temperature region above 700° C. Solid solution strengthening is thought to make a major contribution in the composition of the present invention. Further, Nb has a C and N fixing action that works effectively to prevent a decline in toughness. In the present invention, effective improvement of high-temperature strength by Nb is ensured by incorporating the element in an amount satisfying Expression (1)

$$Nb \geqq 8(C+N) \quad (1).$$

However, excessive Nb addition lowers workability and low-temperature toughness, and increases susceptibility to hot weld cracking. It also reduces the suitable pipe-making condition rate discussed hereinafter. Nb content is therefore defined as not more than 0.5 mass %.

Ti fixes C and N and is generally known to be effective for improving formability and preventing toughness reduction. However the situation is different at a weld. Most N is fixed in the form of TiN but under exposure to high temperatures during welding, the TiN decomposes and the N thereof once enters solid solution in the high-temperature region. Although TiN is formed in the high-temperature region near the solidifying point of the steel, the very rapid cooling rate after welding makes it impossible to fix N thoroughly by Ti alone during the post-welding cooling period. As a result, N tends to be present in solid solution at the weld. Therefore, as will be gone into in detail later, this invention calls for addition of Al in combination with Ti. In order to thoroughly manifest the C and N fixing effect of Ti, the content of Ti must be made 0.05 mass % or greater. But excessive addition of Ti degrades surface property by causing generation of a large amount of TiN and also has an adverse effect on weldability and low-temperature toughness. Ti content is therefore defined as 0.05-0.3 mass %.

Al is an element commonly used as a deoxidizer and for improvement of high-temperature oxidation resistance. In this invention, however, it is particularly important as an element for fixing N at welds. As pointed out above, in the cooling phase after welding, it is impossible to fix N adequately at the weld by Ti alone. Unlike Ti, Al forms a nitride in the relatively low-temperature region below 1000° C. Addition of Al together with Ti therefore makes it possible to effectively fix N at the weld during post-welding cooling, thus mitigating toughness reduction at the weld. In addition, the fixing of N by Ti and Al mitigates strain aging and improves secondary workability at the weld.

At the weld, Al not only fixes N present in the steel but also acts to directly prevent entry of external N and/or O (oxygen) into the steel of the weld. This is significant because the atmosphere to which the molten metal is exposed during pipe-making (ordinarily shielded by $N_2$, Ar or the like) entrains air, and when the amount entrained is great, N and O in the atmosphere tend to enter the steel from the weld to cause toughness reduction. However, in a ferritic stainless steel having an appropriate Al content, the Al in the steel acts to prevent entry of N and O from the atmosphere. Although the mechanism involved is not altogether clear, from the fact that analysis of the weld surface layer of a welded steel pipe made from the invention steel found concentration of Al, it is likely that $Al_2O_3$ formed by Al in the steel during welding blocks dispersion of N and O into the interior.

An Al content exceeding 0.03 mass % must be established to fully bring out this effect of Al and thereby expand the range of freedom in selecting suitable pipe-making conditions in high-frequency welding pipe-making. However, when the Al content is excessive, oxides are abundantly formed during welding and operate disadvantageously as starting points for deformation cracking. The upper limit of Al content is therefore defined as 0.12 mass %.

The Al content must be further regulated relative to the O (oxygen) content of the steel so as to satisfy Expression (2)

$$0.02 \leqq Al-(54/48)O \leqq 0.1 \quad (2).$$

As demonstrated by the Examples set out later, the freedom in selecting suitable pipe-making conditions in high-frequency welding pipe-making is markedly improved in the range of Al content satisfying Expression (2). The amount of Al represented by "Al−(54/48)O" is the Al remaining at the weld (called "effective Al" herein) after subtracting the Al consumed to form $Al_2O_3$ by reaction with O present in the steel. It is thought that when the amount of effective Al rises to and above 0.02 mass %, O contained in the atmosphere during welding and the effective Al promptly unite to effectively block dispersion of N and O present in the atmosphere into the interior, thereby markedly improving the freedom in selecting suitable pipe-making conditions in high-frequency welding pipe-making. However, when the amount of effective Al comes to exceed 0.1 mass %, the freedom in selecting suitable pipe-making conditions declines sharply. The reason for this is probably that excessive Al oxides are formed at the weld and become starting points for deformation cracking.

Cu is an important element for enhancing high-temperature strength. More specifically, the present invention utilizes the finely dispersed precipitation of the Cu phase (sometimes called the ε-Cu phase) to enhance strength particularly at 500-700° C. A Cu content exceeding 1 mass % is therefore required. However, since too large a Cu content degrades workability, low-temperature toughness and weldability, Cu content is limited to not more than 2 mass %.

V contributes to high-temperature strength improvement when added in combination with Nb and Cu. And when co-present with Nb, V improves workability, low-temperature toughness, resistance to grain boundary corrosion susceptibility, and toughness of weld heat affected regions. But since excessive addition degrades workability and low-temperature toughness, V content is made not more than 0.2 mass %. V content is preferably 0.01-0.2 mass %, more preferably 0.03-0.15 mass %.

B is effective for inhibiting secondary working brittleness. The mechanism involved is thought to be reduction of oxygen in solid solution at the grain boundaries and/or grain boundary strengthening. However, excessive B addition degrades productivity and weldability. In this invention, B content is defined as 0.0005-0.02 mass %.

As O (oxygen) adversely affects weld toughness, the amount present in the steel is preferably minimal. O content is also preferably kept as low as possible in order to maintain the effective Al mentioned earlier at the required level. O content must be kept to 0.01 mass % or less and also made to satisfy Expression (2) relative to Al content.

Mo, W, Zr and Co are effective for improving the high-temperature strength of the ferritic stainless steel having the composition defined by the present invention. One or more thereof can be added as required. Owing to their embrittling effect on the steel when added in a large amount, however, the content of these elements, when added, is made not more than 4 mass % in total. Addition to a total content of 0.5-4 mass % affords optimum effect.

The ferritic stainless steel of the foregoing composition can be produced by the melting method using a steelmaking process for ordinary stainless steel and thereafter be formed into annealed steel sheet of around 1-2.5 mm thickness by, for example, a process of "hot rolling→annealing→pickling," which may be followed by one or more cycles of a process of "cold rolling→annealing→pickling." However, in order to achieve excellent high-temperature strength by Cu-phase precipitation, the average cooling rate from 900° C. to 400° C. in final annealing should preferably be controlled to 10-30° C./sec. By "final annealing" is meant the last annealing conducted in the steel sheet production stage and is, for instance, a heat treatment of holding the steel at a temperature of 950-1100° C. for a soaking time of 0-3 minutes.

The annealed sheet (pipe material) is roll-folded into a prescribed pipe shape and the so-formed butt joint of the material is welded to make a pipe and thus obtain a welded steel pipe. The welding can be done by TIG welding, laser welding, high-frequency welding or any of various known pipe welding methods. The obtained steel pipe is subjected to heat treatment and/or pickling as required, and then formed into an exhaust gas passage component.

EXAMPLES

The ferritic stainless steels of Table I were produced by the melting method and each was formed into two annealed steel sheets of different thickness, 2.0 mm and 1.5 mm, by the process of "hot rolling→annealing/pickling→cold rolling→final annealing/pickling." The final annealing was conducted by holding at 1050° C. for 1 minute (soaking) and then cooling at an average cooling rate from 900° C. to 400° C. of 10-30° C./sec.

TABLE 1

| | Steel | Chemical Composition (Mass %) | | | | | | | | | | | | | | [Nb] | [Al] |
|---|---|---|---|---|---|---|---|---|---|---|---|---|---|---|---|---|---|
| | No. | C | Si | Mn | Ni | Cr | Nb | Ti | Al | Cu | V | N | B | O | Others | *1 | *2 |
| Invention | 1 | 0.003 | 0.26 | 0.32 | 0.11 | 17.84 | 0.49 | 0.15 | 0.041 | 1.41 | 0.07 | 0.006 | 0.0020 | 0.0036 | — | 0.42 | 0.037 |
| | 2 | 0.006 | 0.35 | 0.16 | 0.10 | 16.99 | 0.35 | 0.14 | 0.105 | 1.36 | 0.15 | 0.004 | 0.0005 | 0.0058 | — | 0.27 | 0.098 |
| | 3 | 0.009 | 0.58 | 0.49 | 0.11 | 13.25 | 0.35 | 0.10 | 0.045 | 1.50 | 0.16 | 0.005 | 0.0011 | 0.0019 | — | 0.24 | 0.043 |
| | 4 | 0.011 | 0.85 | 0.66 | 0.10 | 13.88 | 0.46 | 0.05 | 0.035 | 1.09 | 0.03 | 0.010 | 0.0030 | 0.0022 | — | 0.29 | 0.033 |
| | 5 | 0.008 | 0.12 | 0.39 | 0.10 | 18.06 | 0.20 | 0.25 | 0.088 | 1.33 | 0.05 | 0.009 | 0.0022 | 0.0009 | — | 0.06 | 0.087 |
| | 6 | 0.005 | 0.22 | 0.78 | 0.58 | 17.55 | 0.31 | 0.11 | 0.056 | 1.94 | 0.04 | 0.008 | 0.0012 | 0.0020 | — | 0.21 | 0.054 |
| | 7 | 0.006 | 0.46 | 0.55 | 0.06 | 14.06 | 0.48 | 0.29 | 0.031 | 1.21 | 0.03 | 0.006 | 0.0026 | 0.0087 | — | 0.38 | 0.021 |
| | 8 | 0.007 | 0.29 | 1.28 | 0.10 | 10.08 | 0.47 | 0.16 | 0.066 | 1.16 | 0.05 | 0.011 | 0.0005 | 0.0022 | — | 0.33 | 0.064 |
| | 9 | 0.010 | 0.36 | 0.26 | 0.17 | 18.99 | 0.46 | 0.08 | 0.042 | 1.26 | 0.06 | 0.008 | 0.0016 | 0.0011 | — | 0.32 | 0.041 |
| | 10 | 0.008 | 0.15 | 0.22 | 0.12 | 17.06 | 0.29 | 0.14 | 0.044 | 1.44 | 0.08 | 0.009 | 0.0015 | 0.0026 | Mo: 2.26 | 0.15 | 0.041 |
| | 11 | 0.006 | 0.14 | 0.19 | 0.09 | 18.12 | 0.21 | 0.12 | 0.038 | 1.26 | 0.06 | 0.008 | 0.0021 | 0.0029 | W: 3.17 | 0.10 | 0.035 |
| | 12 | 0.007 | 0.19 | 0.23 | 0.13 | 18.21 | 0.32 | 0.16 | 0.031 | 1.35 | 0.07 | 0.009 | 0.0019 | 0.0020 | Co: 3.75 | 0.19 | 0.029 |
| | 13 | 0.006 | 0.18 | 0.25 | 0.11 | 18.35 | 0.31 | 0.15 | 0.033 | 1.28 | 0.04 | 0.006 | 0.0017 | 0.0021 | Zr: 1.49 | 0.21 | 0.031 |
| | 14 | 0.006 | 0.57 | 0.22 | 0.10 | 11.22 | 0.29 | 0.10 | 0.040 | 1.44 | 0.05 | 0.007 | 0.0005 | 0.0031 | Mo: 1.88, W: 2.08 | 0.19 | 0.037 |
| Comparative | 21 | 0.008 | 0.26 | 0.22 | 0.10 | 17.05 | 0.42 | 0.15 | 0.006 | 1.38 | 0.04 | 0.009 | 0.0005 | 0.0015 | | 0.28 | 0.004 |
| | 22 | 0.010 | 0.31 | 0.51 | 0.12 | 18.39 | 0.31 | 0.12 | 0.015 | 1.56 | 0.09 | 0.012 | 0.0039 | 0.0014 | | 0.13 | 0.013 |
| | 23 | 0.007 | 0.54 | 0.61 | 0.09 | 16.44 | 0.41 | 0.21 | 0.188 | 1.24 | 0.06 | 0.016 | 0.0041 | 0.0007 | | 0.23 | 0.187 |
| | 24 | 0.009 | 0.35 | 0.16 | 0.10 | 16.95 | 0.38 | 0.10 | 0.125 | 1.05 | 0.05 | 0.010 | 0.0010 | 0.0059 | | 0.23 | 0.118 |
| | 25 | 0.008 | 0.25 | 0.32 | 0.14 | 17.88 | 0.54 | 0.14 | 0.068 | 0.75 | 0.07 | 0.012 | 0.0008 | 0.0021 | | 0.38 | 0.066 |
| | 26 | 0.013 | 0.22 | 0.38 | 0.13 | 16.87 | 0.37 | 0.36 | 0.054 | 1.44 | 0.03 | 0.009 | 0.0012 | 0.0028 | | 0.19 | 0.051 |
| | 27 | 0.010 | 0.11 | 0.44 | 0.13 | 16.88 | 0.50 | 0.25 | 0.040 | 1.45 | 0.06 | 0.009 | 0.0025 | 0.0159 | | 0.35 | 0.022 |
| | 28 | 0.009 | 0.26 | 0.22 | 0.15 | 15.57 | 0.68 | 0.13 | 0.081 | 1.35 | 0.05 | 0.011 | 0.0014 | 0.0041 | | 0.52 | 0.076 |
| | 29 | 0.012 | 0.33 | 0.24 | 0.10 | 14.88 | 0.45 | 0.29 | 0.025 | 1.14 | 0.05 | 0.011 | 0.0015 | 0.0022 | | 0.27 | 0.023 |

*1: [Nb] = Nb − 8(C + N),
*2: [Al] = Al − (54/48)O,
Underline: Outside invention range

Example 1

High-Frequency Welding Pipe-Making

High-frequency welding pipe-making was carried out under various conditions using the 2.0-mm steel sheet materials. The welded steel pipes manufactured had an outside diameter of 38.1 mm and a wall thickness of 2.0 mm.

<Suitable Pipe-Making Condition Rate>

The "suitable pipe-making condition rates (%)" of the obtained steel pipes were determined by the following method.

In the high-frequency welding pipe-making, the upset amount and heat input conditions that resulted in a metal flow angle of 45° were defined as the "optimum conditions" for the type of steel concerned. In the structure etched of the weld cross-section where a metal flow curve like that shown FIG 1(*a*) appears, the angle between a line drawn to lie ¼ the wall thickness inward from the steel pipe outer surface (called the "reference line") and the metal flow curve is defined as θ (see FIG. 1(*b*)) and the maximum value of θ in the steel pipe is defined as the metal flow angle of the steel pipe. In other words, the metal flow angle is measured by selecting from among the various metal flow curves the metal flow curve that makes the largest angle θ with the reference line. By "upset amount" is meant the butting amount of the sheet edges together during pipe welding. As a welding term, it is synonymous with "upset force." By "heat input" is meant the electrical power of the high-frequency welding (=current× voltage).

High-frequency welding pipe-making was carried out using each type of steel sheet under 15 sets of welding conditions by varying "upset amount" among 3 levels (−30%, 0%, +30%) and "heat input" among 5 levels (−40%, −20%, 0%, +20%, +40%), where the two 0% values represent the foregoing "optimum conditions" as the standard. A pipe measuring about 1000 mm in length was cut from the steel pipe obtained under the each set of welding conditions, immersed for 15 minutes in a tank of 5° C. water, and then immediately subjected to a flattening test in accordance with JIS G3459, wherein the weld was placed at right angle to the direction of compression by flat jig plates and the distance H between the plates after compression was ⅓ the outside pipe diameter before compression. The percentage of the total of 15 sets of conditions for which no embrittlement was observed was calculated and defined as the "suitable pipe-making condition rate (%)" of the steel concerned.

A steel type whose suitable pipe-making condition rate calculated in this manner was 60% or greater was rated to be one enabling reliable manufacture of high-frequency welded steel pipe possessing the excellent weld toughness required by automobile exhaust gas passage components irrespective of the season of the year (temperature).

<Weld Transition Temperature>

A test specimen including the weld was cut from the high-frequency welded steel pipe made from each steel type under the "optimum conditions." The transition temperature of the specimen was determined by conducting an impact test with the specimen set in a Charpy impact tester so that the hammer struck on the weld. A steel whose weld transition temperature was 0° C. or lower was rated "good."

Example 2

Laser Welding Pipe-Making

Laser welding pipe-making was carried using the 1.5-mm steel sheet materials. The welded steel pipes manufactured had an outside diameter of 65 mm and a wall thickness of 1.5 mm. The welding conditions were such that the width of the rear bead of the weld was about the same as the wall thickness (in the range of 1.5-2.0 mm).

<Weld Transition Temperature>

A test specimen including the weld was cut from each welded steel pipe and the transition temperature was determined by conducting an impact test by the method explained above. A steel whose weld transition temperature was 0° C. or lower was rated "good".

Example 3

High-Temperature Strength Measurement

The 2.0-mm steel sheet materials made from the steels of Table 1 were subjected to high-temperature tensile testing. A 0.2% yield strength at 900° C. of 17 MPa or greater was rated G (good) and one of less than 17 MPa was rated P (Poor).

Figure 2:
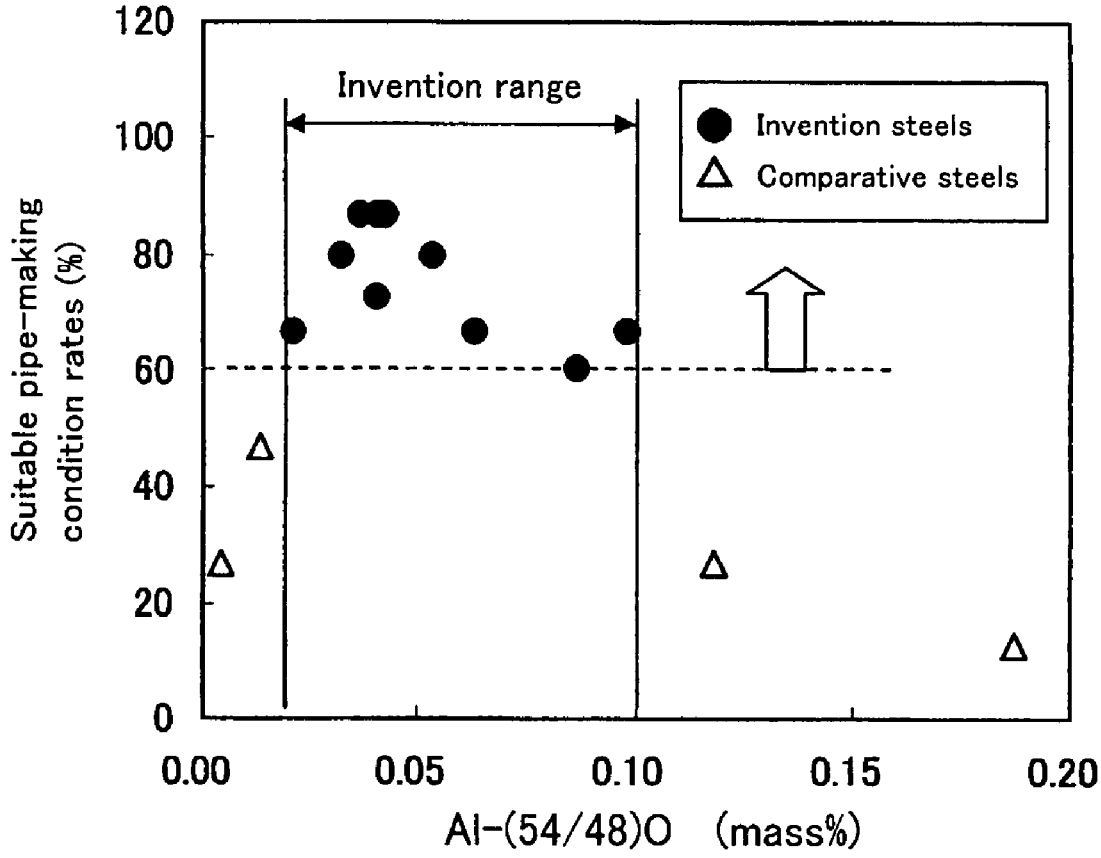
FIG. 2 is a graph showing how suitable pipe-making condition rate varied with effective Al content (Al–(54/48)O).

The results obtained are shown in Table 2, while FIG. 2 shows how suitable pipe-making condition rate varied with effective Al content (Al−(54/48)O) in the invention steels and comparative steels Nos. 21-24.

TABLE 2

| | | High-frequency pipe-making | | | |
|---|---|---|---|---|---|
| | Steel No. | Suitable pipe-making condition rate (%) | Weld transition temperature (° C.) | Laser pipe-making Weld transition temperature (° C.) | High-temperature strength |
| Invention steels | 1 | 87 | 0 | 0 | G |
| | 2 | 67 | −25 | −25 | G |
| | 3 | 87 | −25 | −25 | G |
| | 4 | 80 | 0 | −25 | G |
| | 5 | 60 | −25 | −25 | G |
| | 6 | 80 | −25 | −25 | G |
| | 7 | 67 | 0 | 0 | G |
| | 8 | 67 | 0 | −25 | G |
| | 9 | 73 | 0 | 0 | G |
| | 10 | 87 | 0 | 0 | G |
| | 11 | 80 | 0 | 0 | G |
| | 12 | 73 | 0 | 0 | G |
| | 13 | 80 | 0 | 0 | G |
| | 14 | 87 | 0 | 0 | G |
| Comparative steels | 21 | 27 | 25 | 25 | G |
| | 22 | 47 | 25 | 25 | G |
| | 23 | 13 | 50 | 50 | G |
| | 24 | 27 | 50 | 50 | G |
| | 25 | 87 | 0 | −25 | P |
| | 26 | 80 | 25 | 50 | G |

TABLE 2-continued

| Steel No. | High-frequency pipe-making: Suitable pipe-making condition rate (%) | High-frequency pipe-making: Weld transition temperature (° C.) | Laser pipe-making Weld transition temperature (° C.) | High-temperature strength |
|---|---|---|---|---|
| 27 | 47 | 25 | 50 | G |
| 28 | 67 | 0 | 0 | G |
| 29 | 40 | 25 | 25 | G |

Underline: Unacceptable

As seen in Table 2, the ferritic stainless steels whose compositions were within the range defined by the present invention (invention steels) all exhibited suitable pipe-making condition rates of 60% or greater in high-frequency welding pipe-making. They were excellent in the transition temperature and high-temperature strength of the welds, thus confirming their suitability for use in exhaust gas passage components that undergo harsh working during fabrication. Of particular note is that freedom in selecting suitable pipe-making conditions was markedly improved by optimizing the relationship between Al content and O (oxygen) content so as to satisfy Expression (2) (see FIG. 2).

In contrast, the comparative steels Nos. 21 and 22 were low in Al content, so that adequate effective Al content as defined by Expression (2) could not be achieved. This is thought to have made it impossible to thoroughly prevent entry of N and O from the air during welding, leading to the inferior suitable pipe-making condition rate and low-temperature toughness of the weld. To the contrary, the Al content of comparative steels Nos. 23 and 24 was too high, causing Al oxides to form abundantly at the weld. This is thought to account for the low toughness. No. 25 was poor in high-temperature strength owing to too low Cu content. No. 26 was poor in low-temperature toughness owing to excessive Ti content. Because of the excessive O (oxygen) content of the steel, No. 27 experienced declines in both low-temperature toughness of the weld and suitable pipe-making condition rate even though it satisfied Expression (2). The suitable pipe-making condition rate of No. 28 was low because of excessive Nb content. Although No. 29 satisfied Expression (2), its insufficient Al content made it inferior to the invention steels in suitable pipe-making condition rate and low-temperature toughness of the weld.

What is claimed is:

1. A ferritic stainless steel for automobile exhaust gas passage components comprising, in mass percent, C: not more than 0.03%, Si: not more than 1%, Mn: not more than 1.5%, Ni: not more than 0.6%, Cr: 10-20%, Nb: not more than 0.5%, Ti: 0.05-0.3%, Al: more than 0.03% to 0.12%, Cu: more than 1% to 2%, V: not more than 0.2%, N: not more than 0.03%, B: 0.0005-0.02%, O: not more than 0.01%, and the balance of Fe and unavoidable impurities, the composition satisfying Expressions (1) and (2)

$$Nb \geqq 8(C+N) \quad (1),$$

$$0.02 \leqq Al-(54/48)O \leqq 0.1 \quad (2).$$

2. The ferritic stainless steel for automobile exhaust gas passage components according to claim 1, further including one or more of Mo, W, Zr and Co in a total of not more than 4%.

3. A welded steel pipe made of a steel of claim 1.

4. An automobile exhaust gas passage component fabricated by forming a welded steel pipe made of a steel of claim 1.

5. An automobile exhaust gas passage component according to claim 4 that is an exhaust manifold, a catalytic converter case, a front pipe or a center pipe.

6. A welded steel pipe made of a steel of claim 2.

7. An automobile exhaust gas passage component fabricated by forming a welded steel pipe made of a steel of claim 2.

* * * * *